United States Patent [19]

Groth et al.

[11] Patent Number: 5,031,948

[45] Date of Patent: Jul. 16, 1991

[54] BAG HANDLING SYSTEM

[75] Inventors: James A. Groth, Aberdeen; Trent A. Nilson, Worthing, both of S. Dak.

[73] Assignee: Idea Development, Inc., Worthing, S. Dak.

[21] Appl. No.: 292,944

[22] Filed: Oct. 3, 1989

[51] Int. Cl.[5] ..... B65B 67/12

[52] U.S. Cl. ..... 294/1.1; 15/257.1; 15/257.7; 248/101; 294/55

[58] Field of Search ..... 294/1.1, 1.3–1.5, 294/55; 15/257.1, 257.4, 257.7–257.9; 56/400.11–400.13; 141/108, 109, 390, 391; 248/97, 99–101; 383/33

[56] References Cited

U.S. PATENT DOCUMENTS

| | | | |
|---|---|---|---|
| 637,248 | 11/1899 | Hagstrom | 248/101 |
| 3,253,812 | 5/1966 | Okazaki | 248/101 X |
| 3,733,099 | 5/1973 | Szita | 294/55 |
| 3,916,962 | 11/1975 | Stolt | 294/1.3 X |
| 4,238,868 | 12/1980 | Sternberg | 15/257.4 |
| 4,270,788 | 6/1981 | Overholt | 294/55 |
| 4,550,440 | 10/1985 | Rico | 294/55 X |
| 4,629,233 | 12/1986 | Pfisterer | 294/55 X |
| 4,723,803 | 2/1988 | Sapp | 294/55 |
| 4,759,519 | 7/1988 | Cheng | 294/55 X |
| 4,787,584 | 11/1988 | Palmer | 248/101 X |

*Primary Examiner*—Johnny D. Cherry

[57] ABSTRACT

A bag handling system used to facilitate the filling of bag by holding the bag open. The bag handling system is comprised of an inner locking frame through which the open end of a bag is passed such that it can be folded over the inner frame. The inner frame is then inserted in and secured into the channel of an outer base frame. The outer base frame includes an integrated hand grip and rails for the attachment of an extension handle/support leg. The outer base frame also has guide grooves for the attachment of a sweep pan to channelize the fill into a bag.

6 Claims, 7 Drawing Sheets

BAG HANDLING SYSTEM

BACKGROUND OF THE INVENTION

This invention relates to a bag handling system which may be used to hold receptacle bags open so that items to fill bags may be easily passed through the opening of the bag. Specifically, this bag handling system is singular unique in that it provides a handle/support system allowing for the ease of movement of the system and multiple utility as a vertical storage system, and horizontal collection device.

The receptacle bags are generally made of polyethylene which is very flexible and difficult for one person to load or fill. When used to store matter or fill in a vertical position/ the bags are generally inserted in a container to hold them in position. Although the container provides support for the polyethylene bag, it allows the open end to collapse into the container because it does not secure the bag in an open position.

Throughout the prior art there are examples of frames created to hold bags open. These frames have taken on many shapes, but all generally conform to the opening of the bags they are used to support.

The bags are fastened to their frames by numerous methods. Some are clamped, others are pinched and some are squeezed. In all cases, some type of frictional or stretch methodology is used to retain the polyethylene bags. None of these known frames positively lock the bag in place as does the present invention.

The present art shows many developments as to the gripping member of the bag holder. Some bag holders have hand grips integrated into their body, requiring severe bending in order to pick the bag up to move it. Other holders have no handles at all, which detracts from the facility of moving the bag. U.S. Pat. No. 3,754,785 discloses an elongated handle, but does not disclose the handle mounted at an angle as in the present invention to facilitate movement of the holder without tipping the apparatus. In the present invention, mounting of the detachable handle on either side allows for left or right hand ease of use without tipping and for dragging the holder.

Finally, the prior art in U.S. Pat. No. 4,411,300 discloses the vertical mounting of the bag in an additional complex mounting frame. This mounting device protrudes from the wall making it cumbersome when not in use. Also, the two protruding members of the holder can pose a danger.

SUMMARY OF THE INVENTION

The present invention overcomes the shortcoming in the previous art by providing an independent snap locking system to hold the bag in place, an extension handle mounting on the left or right side to facilitate ease of movement without tipping or spillage, and a simplified holding system.

In the preferred embodiment an outer base ring or frame has integral to it snap tabs and thumb locking-/release tabs. These tabs secure an inner locking frame in position thereby securing the bag securely in the open position. This locking method does not rely on friction and is not subject to normal wearing that occurs in the frictional method of holding. Further, the thumb locking/release tabs allow for quick release of the bags.

Bending over to reach the bag holder for purpose of movement or stabilization of the holder while placing matter or fill into the bag is alleviated with the extension handle/support leg. This handle allows the user to remain vertical while maintaining the stability of the system when moving matter or fill over the pan and through the holder into the bag. The facility of this handle is enhanced by the mounting of the handle on the side of the bag handling system, allowing the users to stand to the side of the handling system while guiding the handling system and the device being used to move the matter or fill into the bag. The extension handle lessens the requirement for bending and sweeping and-/or bending and dragging of the bag handling system. Further, because the extension handle mounts on either side it is capable of being used in difficult to reach areas and is equally as beneficial to left or right handed users.

A vertical mounting system is integral to the bag handling system. It does not require any additional members to mount to any wall. The mounting system consists of two holes molded into the sweeping tray. In the preferred embodiment, these said holes are 16 inches apart, the width between framing studs in most homes. In order to mount the bag handling system to the wall, two screws are placed in sequential studs, at a height above the floor equal to the length of the extension handle/support leg, and the bag handling system is hung on the screws. For additional support and convenience of storage, the extension handle/support leg is fixed to the outer base frame.

The preferred embodiment of the invention is capable of both horizontal and vertical use. In either use all members are used and no additional members are required.

DESCRIPTION OF PREFERRED EMBODIMENT

Figure 1:
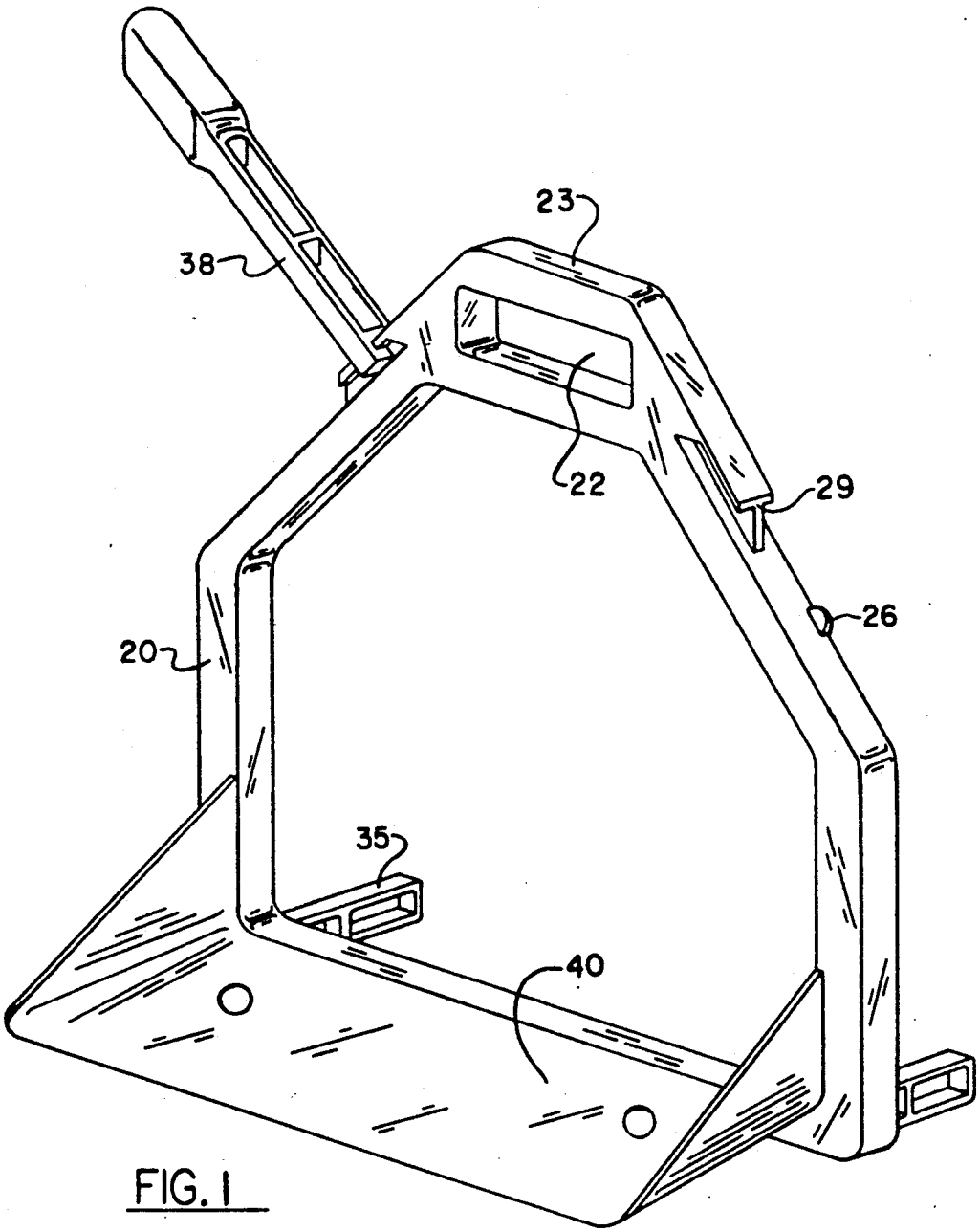
FIG. 1 shows the bag handling system of the present invention in assembled condition.
Figure 2:
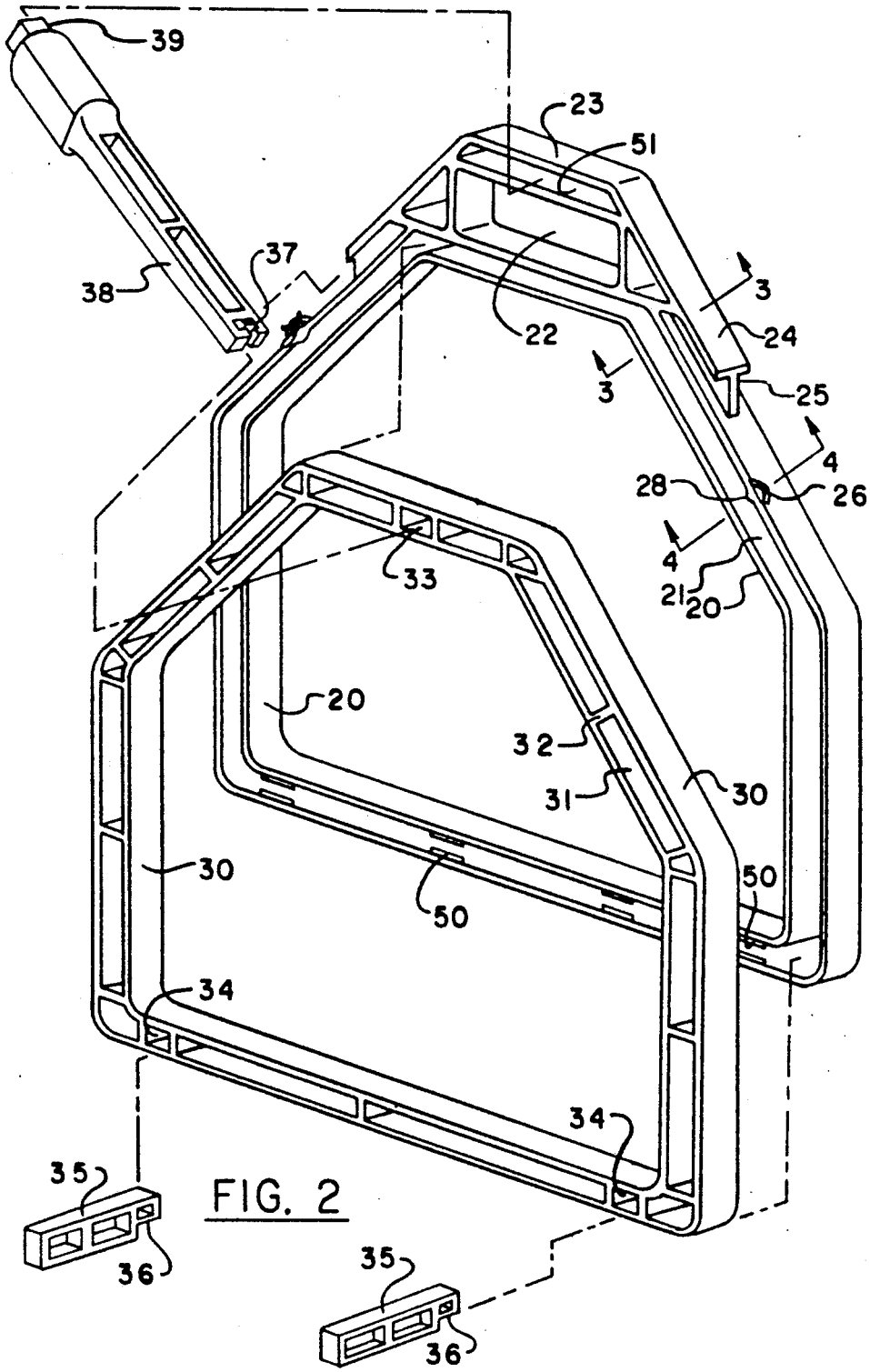
FIG. 2 shows the parts of the bag handling system, minus the sweeping tray, in disassembled condition.

Referring first to the embodiment of the bag handling system as shown in FIGS. 1 and 2, the invention includes an outer base frame 20, an inner bag retaining frame 30, thumb locking/release tabs 26, feet 35, sweeping pan 40, and an extension handle/support leg 38.

Outer base frame 20 is of channel-shaped cross-section to form a trough, or channel 21 continuously throughout the outer base frame 20. Integrated into the outer base frame 20 and projecting into the trough 21 opening are snap tabs 50 and locking tabs 28. Locking tabs 28 are opposed by thumb release tab 26.

An inner bag retaining frame 30 is shaped to fit into trough 21 of outer base frame 20. The open end of a polyethylene bag is received within the inner bag retaining frame 30 to a distance to allow the open end of the bag to be circumjacently folded over the inner bag retaining frame 30. The inner bag retaining frame 30 with polyethylene bag 52 circumjacently mounted is first seated into the outer frame past snap tabs 50. Then, the inner bag retaining frame is rotated forward to be engaged by the locking tabs 28. Locking tabs 28 lock inner bag retaining frame 30 and polyethylene bag securely in place.

The inner bag retaining frame 30 has multiple ribs 32 and reliefs 31 throughout. Locating openings 34 for feet 35 are positioned on the lower/bottom side of the inner bag retaining frame 30.

The feet 35 have reduced size ends 36 which frictionally seat into the locating openings for feet 35.

Figure 5:
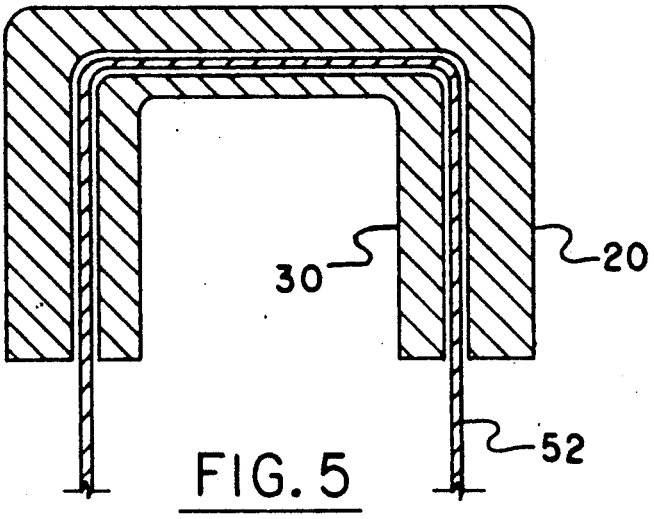
FIG. 5 shows in cross-section, a bag clamped between the inner and outer frames.

FIG. 5 shows the circumjacently folding of polyethylene bag 52 around inner bag retaining frame 30. The positioning of the circumjacently folded polyethylene bag 52 and inner bag retaining frame 30 seated in the trough 21 of outer base frame 20.

Figure 4:
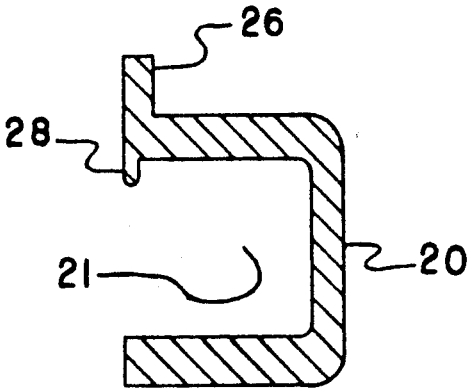
FIG. 4 shows a cross-section of the outer frame taken along line 4—4 of FIG. 2.

FIG. 4 shows the positioning of locking tab 28 across the opening of trough 21 of outer base frame 20. Thumb release tab 26 is rotated clockwise to turn locking tab 28 away from the opening of trough 21 for easy removal of the inner bag retaining frame 30.

Figure 3:
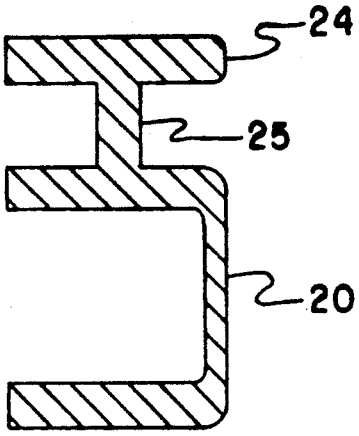
FIG. 3 shows a cross-section of the outer frame taken along line 3—3 of FIG. 2.

Referring to FIGS. 2 and 3, at each side of hand grip 23 is a T-shaped rail 24. These rails 24 are integrally mounted to the outer base frame 20 by stems 25.

Referring to FIGS. 1 and 2, one end of the extension handle/support leg 38 has a T-shaped opening 37. The T-shaped opening can receive a rail 24. This engagement allows the bag handling system to be transported by the extension handle/support leg 38. The engagement of extension handle/support leg with a rail 24 may occur on either side of hand grip 23 depending on the user's preference.

Figure 6:
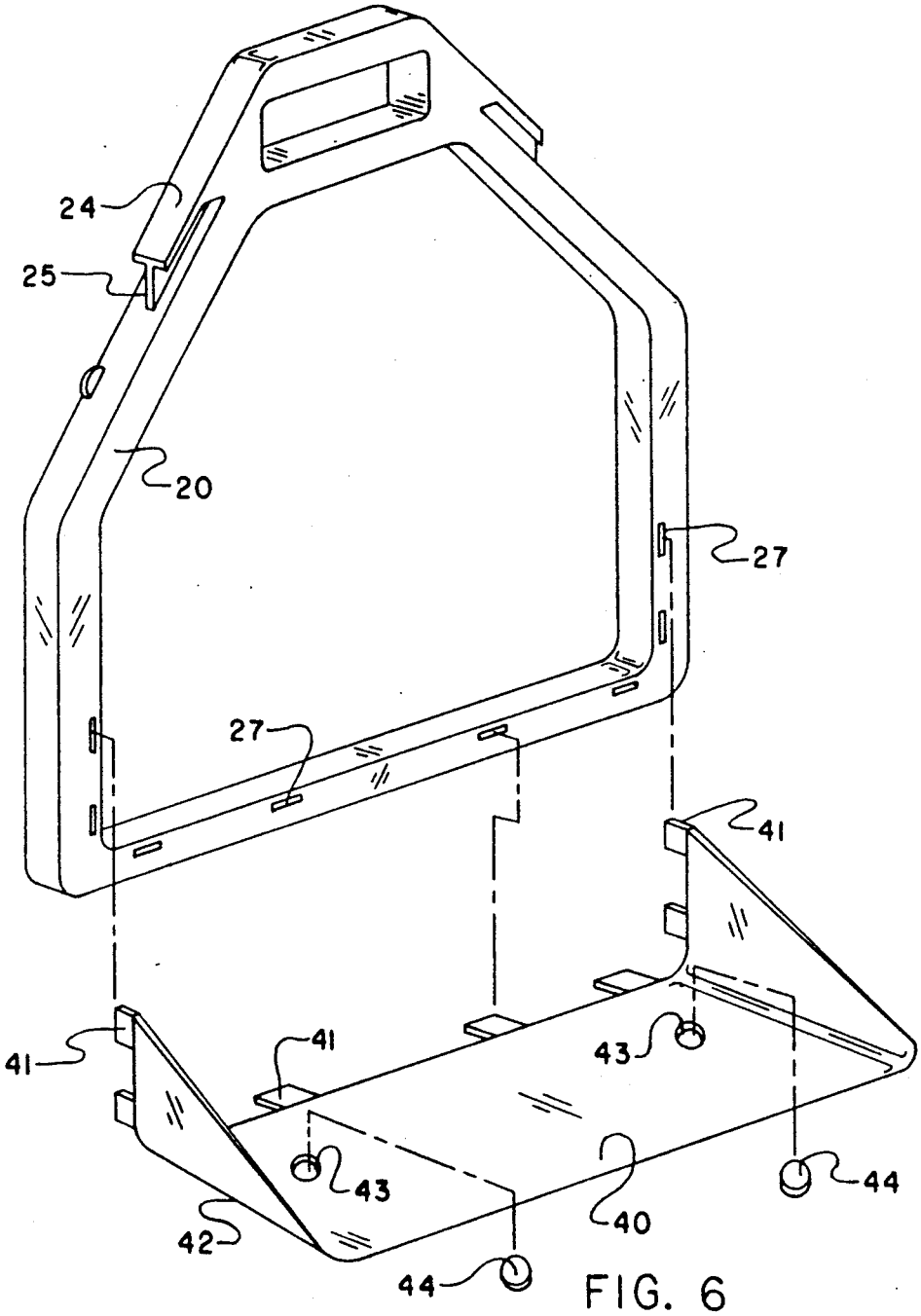
FIG. 6 shows the outer frame and the sweeping pan in disassembled condition.

Referring particularly to FIG. 6, the outer base frame 20 has slots 27 for the attachment of the sweeping tray 40. The sweeping tray 40 has attachment tabs 41 which are snapped into slots 27 thereby locking the sweeping tray 40 in position.

Sweeping tray 40 has channelizing sides 42 to focus the matter or fill into the opening in said bag.

Figure 7:
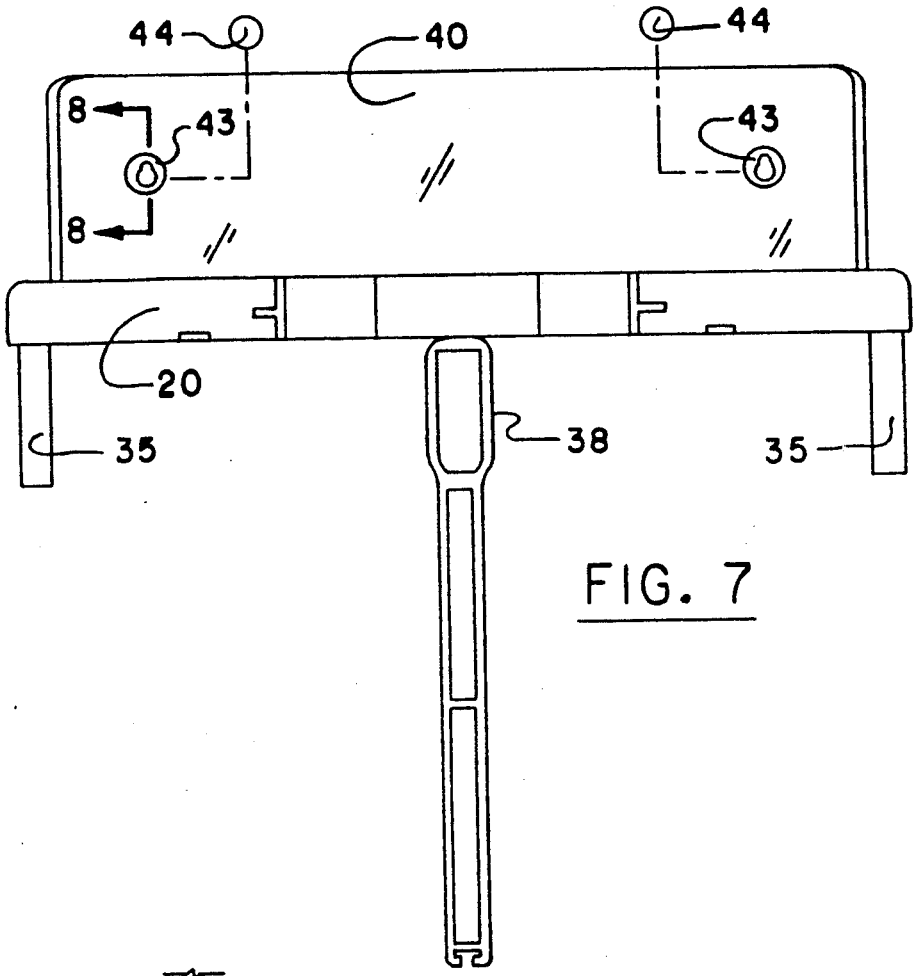
FIG. 7 is a front elevational view of the bag handling system mounted on a vertical surface.
Figure 8:
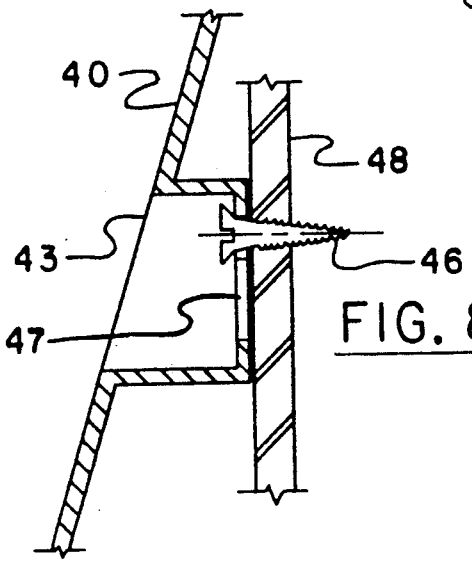
FIG. 8 is a cross-sectional view taken along line 8—8 of FIG. 7.

Referring to FIGS. 7 and 8, the sweeping tray 40 has hanger receiving holes 43 positioned 16 inches apart. The hanger receiving holes 43, receive and lock by gravity onto the holding screw 46 mounted in wall surface 48. The holding screws in their preferential mounting would be 16 inches apart to conform to the standard position of 2×4 studs in building construction.

Referring to FIG. 2 and 7, the hand grip 23 has a support leg opening 51 to receive the extension handle/-support leg 38. The extension handle/support leg 38 has a support leg member 39 which is snapped into said support leg opening 51 when said bag handling system is mounted in the vertical position as shown in FIGS. 7 and 9.

Figure 9:
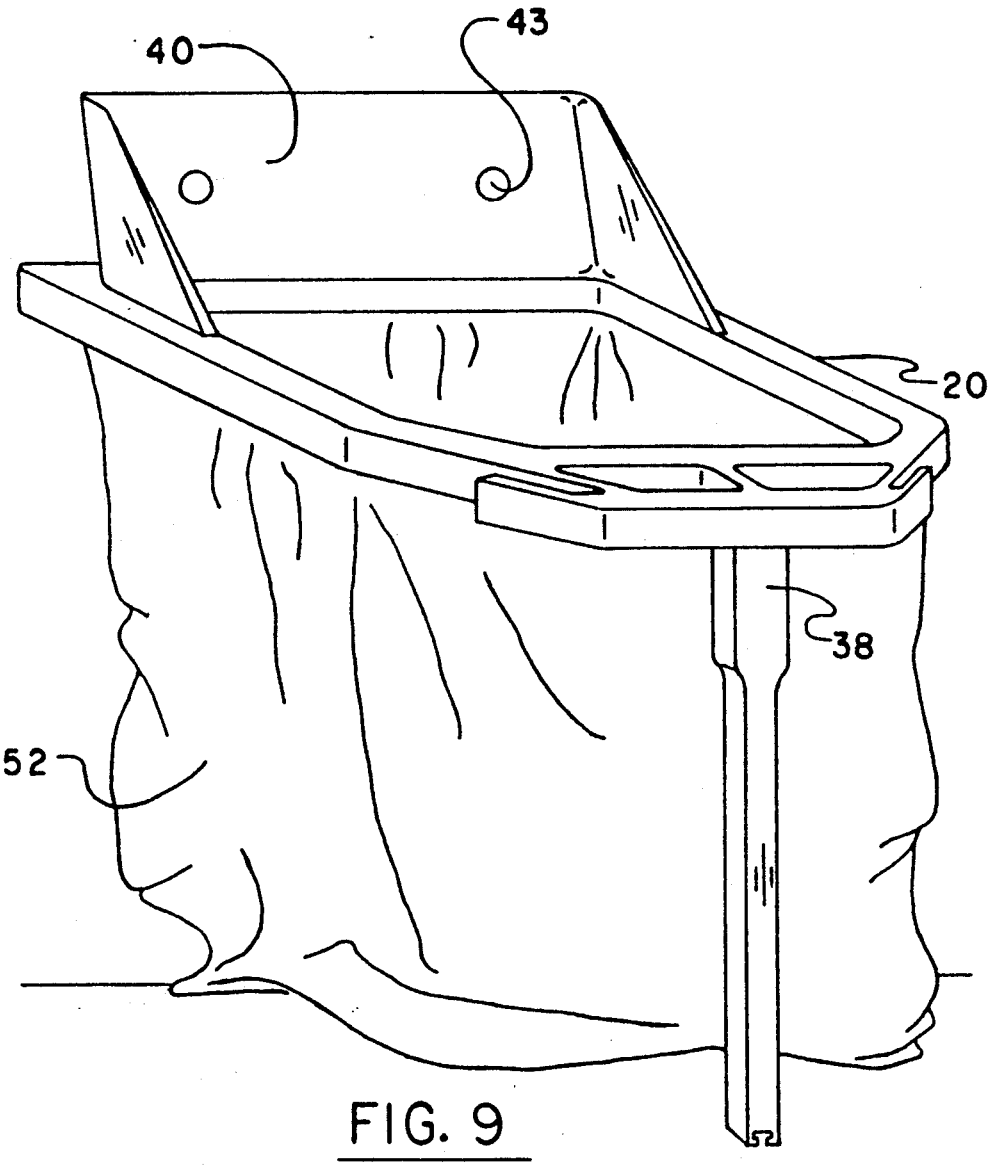
FIG. 9 shows the bag handling system, including a bag, mounted on a vertical surface.

FIG. 9 shows the bag handling system mounted in a vertical position with a polyethylene bag secured by the bag handling system.

Figure 10:
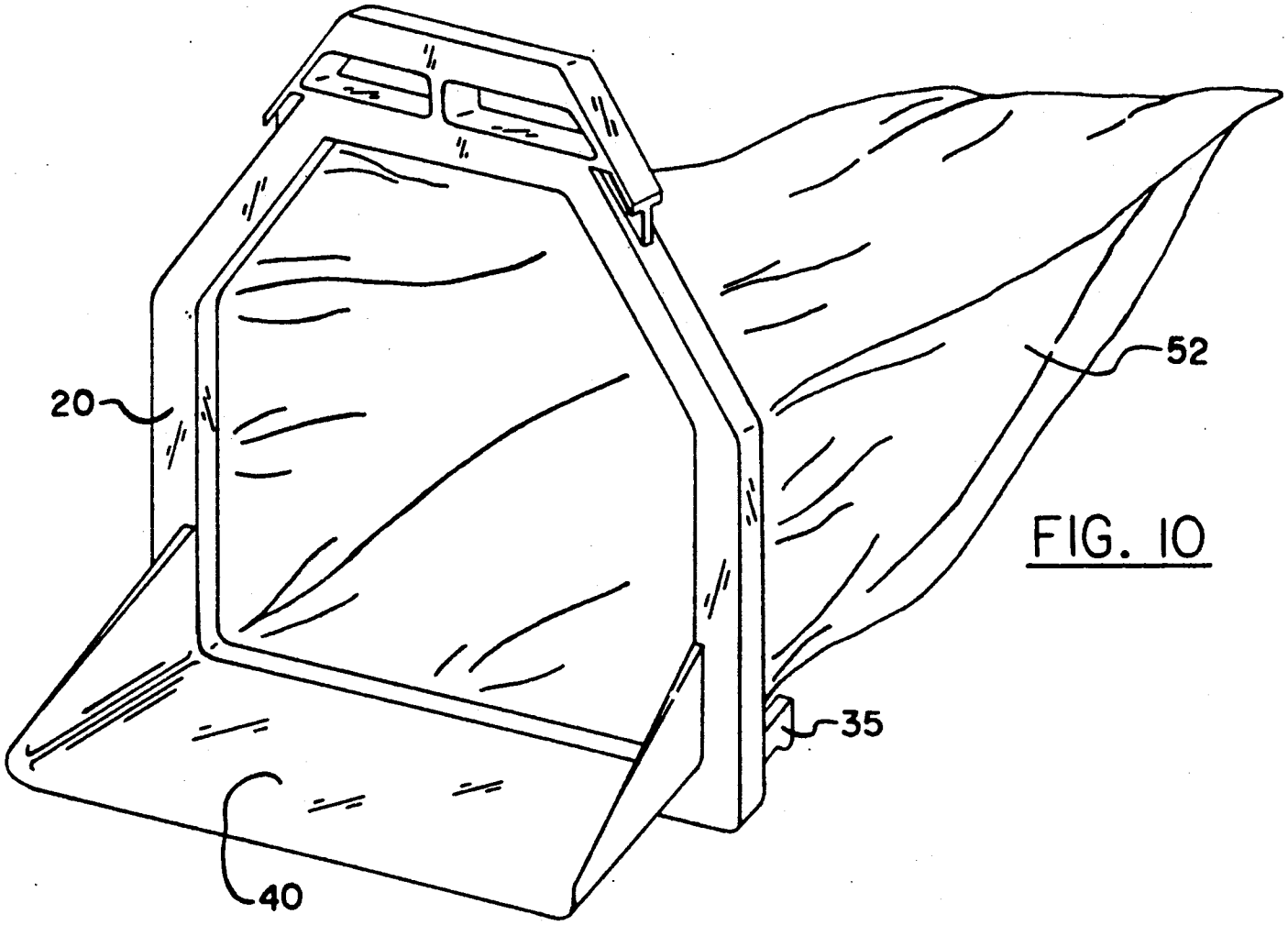
FIG. 10 shows the bag handling system, including a bag, positioned for use on a horizontal surface.

FIG. 10 shows the bag handling system free standing in the horizontal position with a polyethylene bag secured by the bag handling system.

We claim:

1. A bag handling system comprising:

an inner frame defining a central opening therethrough;

an outer frame of channel-shaped cross-section and having a shape corresponding to the shape of said inner frame so that said inner frame can fit within the channel of said outer frame;

a hand grip rigidly joined to said outer frame;

releasable locking tabs provided on said outer frame for holding said inner frame within the channel of said outer frame, said locking tabs extending partially into the channel of said outer frame; and rails rigidly joined to and extending along said outer frame on both sides of said hand grip, said rails serving as a means of releasably attaching an extension handle to said outer frame on either side of said hand grip to facilitate manipulation of an assembly of said outer frame, said inner frame and a bag having its open end extending through the opening of said inner frame and clamped between said inner and outer frames.

2. The bag handling system as defined in claim 1, wherein said rails are of T-shaped cross-section.

3. The bag handling system as defined in claim 1, further comprising an elongated extension handle having a hand gripping formation at one end and a formation at the other end configured to couple with one of said rails to thereby effect a releasable attachment of said extension handle to said outer frame.

4. The bag handling system as defined in claim 1, further comprising a guide tray which is releasably attachable to said outer frame, said guide tray comprising a guide surface which is inclined when said guide tray is attached to said outer frame and said outer frame is vertically oriented, said guide tray thereby facilitating the sweeping of items into the open end of a bag clamped between said inner and outer frames.

5. The bag handling system as defined in claim 4, wherein wall-mounting holes are provided in said guide tray, said holes being spaced to receive fasteners secured to adjacent studs in a vertical wall.

6. The bag handling system as defined in claim 1, further comprising legs which are releasably attachable to said inner frame, said legs, when attached to said inner frame, serving to stabilize said inner and outer frames, assembled together, against a horizontal or vertical support surface.

* * * * *